United States Patent [19]

Breining

[11] Patent Number: 4,861,230

[45] Date of Patent: Aug. 29, 1989

[54] INTERLOCKING FAN GUARD

[75] Inventor: Frank E. Breining, Jackson, Mich.

[73] Assignee: Airmaster Fan Company, Jackson, Mich.

[21] Appl. No.: 311,755

[22] Filed: Feb. 17, 1989

[51] Int. Cl.[4] ..... F04D 29/70

[52] U.S. Cl. ..... 416/247 R

[58] Field of Search ..... 98/1, 94.1; 416/247 R

[56] References Cited

U.S. PATENT DOCUMENTS

| | | | |
|---|---|---|---|
| 1,114,459 | 10/1914 | Fritts | 416/247 R |
| 2,656,974 | 10/1953 | Holstein | 416/247 R |
| 2,658,666 | 11/1953 | Krzesiewski | 416/247 R |
| 3,446,429 | 5/1969 | Suzuki et al. | 416/247 R |
| 3,787,142 | 1/1974 | Dupke | 416/247 R |
| 3,791,333 | 2/1974 | Lusch | 416/247 R X |
| 3,963,382 | 6/1976 | Patton | 416/247 R X |

*Primary Examiner*—Harold Joyce

*Attorney, Agent, or Firm*—Beaman & Beaman

[57] ABSTRACT

A fan guard comprising front and rear portions each including a plurality of radially extending wires circumferentially spaced supporting a plurality of concentrically mounted wire rings. Some of the radially extending wires include an end having a homogeneously extending tab formed thereon. The tabs have a front and back side and are formed by bending the end of the wires into a P-shaped loop defining a slot having parallel edges. The tabs are offset with respect to the portion's joining plane so when the guard portions are assembled the front side of the tabs of the front portion engage the back side of the tabs of the rear portion to form abutments with each other in an interlocked relation preventing axial separation of the guard portions and the loops align to receive a bolt upon which a nut is threaded to secure the guard portions together.

7 Claims, 1 Drawing Sheet

INTERLOCKING FAN GUARD

BACKGROUND OF THE INVENTION

Fan guards are mounted on fans to protect from injury that would result from contact with the rapidly rotating blades. Such fan guards often consist of a pair of guard portions each constructed out of wire and/or screen bent into various forms and having means for securing the portions together. Typical examples of these types of fan guards are shown in U.S. Pat. Nos. 1,114,459 and 3,787,142.

The aforedescribed types of fan guards are relatively inexpensive in construction and employ securing means to provide access to the blades. However, a fan guard that incorporates a simple construction that provides strong resistance to axial separation of the guard portions and is easily assembled has not yet been available for use.

It is an object of the invention to provide a fan guard having a simplified construction comprising front and rear guard portions wherein each of the guard portions include a plurality of homogeneously extending P-shaped tabs that interlock to form abutments with each other to provide strong resistance to axial separation.

It is another object of the invention to provide a fan guard having a simplified construction that can be readily assembled and disassembled and is of low manufacturing cost.

It is yet another object of the invention to provide a fan guard comprising a simplified construction, including front and rear guard portions, that allows air to flow through without being unduly obstructed yet, is of high strength, and when the guard portions are secured in assembled relationship is free of rattling or other noises from vibration imposed on the guard portions from the associated fan motor.

In the practice of the invention the fan guard has front and rear guard portions each including a plurality of wire rings concentrically mounted on a plurality of radially extending support wires. The rear portion is mounted to the frame of the fan motor. Some of the radially extending wires are formed with a loop at the outer end, whereon homogeneous P-shaped tabs extend radially outwardly. When the guard portions are assembled together the rings defining the portions' periphery are adjacent, though slightly spaced, the tabs are bolted together and a cage is formed enclosing the fan blades.

The tabs are formed by bending the outer end of certain of the radially extending support wires into a loop defining a slot having parallel edges. The tabs include front and back sides and are offset with respect to the joining plane such that when the guard portions are assembled the slots align and the front side of the tabs of the front portion interlock with the back side of the tabs of the rear portion to provide strong resistance to axial separation of the guard portions. A carriage bolt is passed through the aligned slots to mate with a nut to secure the guard portions together and as the square neck of the carriage bolt is closely received between the parallel portions of a tab loop a rotation of the bolt during tightening is prevented.

To assemble the guard portions it is merely necessary to bring them together with the peripheral edges of the portions in adjacent relationship so that the plane of the front portion tabs are "behind" the plane of the tabs of the rear portion. By rotating the front portion the offset tabs interlock front-to-back as the tab slots align to receive a carriage bolt and the bolt nut is tightened to secure the guard portions together. To disassemble the fan guard simply loosen the nuts and remove the carriage bolts from the slots. Rotating the front guard portion misaligns the interlocked tabs to allow separation of the guard portions.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
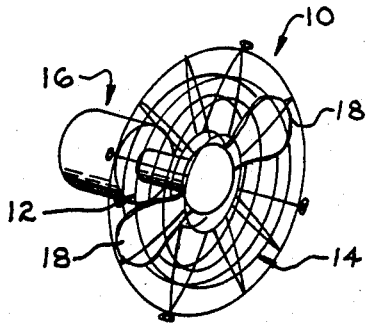
FIG. 1 is a perspective view of a fan utilizing a fan guard in accord with the invention.

A typical fan guard in accord with the invention is disclosed in FIGS. 1-6. The fan guard 10 includes a pair of substantially identical guard portions 12 and 14. Guard portion 12 is the rear portion and is mounted to the frame of a fan motor 16 and the front portion 14 interlocks with the mounted portion 12 to enclose the fan blades 18 mounted on the motor shaft, as shown in FIG. 1.

Each of the guard portions 12,14 is constructed from a plurality of radially extending support wires whereon a plurality of increasingly larger spaced wire rings are concentrically welded thereon. The guards 12,14 including radially extending support wires 20 and 22, respectively, and the outer ends of some of the wires, every third one, for instance, have loops defined thereon forming tabs 24 and 26, respectively. The wires 20,22 are curved radially inwardly at their outer end and, in portion 12, terminate at the inner end adjacent the motor 16 and are attached to the motor 16. The inner ends of wires 22 may attach to a center name plate or a solid guard. The largest wire rings 28 and 28' are mounted adjacent the tabs 24 and 26, respectively, and smaller wire rings 30, 32, 34, are welded to the support wires, as known.

Figure 3:
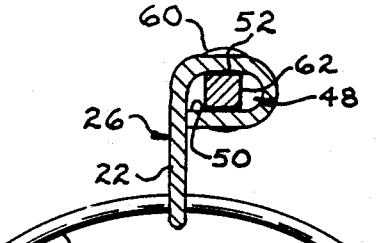
FIG. 3 is an elevational sectional view, taken along Section III—III of FIG. 2.

The tabs 24 and 26 extend beyond the associated ring 28 in an axial direction and are offset with respect to the plane of the rings 28 and each tab includes a slot for receiving the square neck of a carriage bolt. Tab 24 is formed by bending the end of the wire 20 into a P-shaped loop extending to the left, FIG. 5, defining a slot 36 having parallel edges 38 and 40 which extend to one side of the wire 20. Tab 24 also has a front side 42 and a rear side 44. Tab 26 is formed by bending the end of the wire 22 into a P-shaped loop extending to the right, FIG. 5, defining a slot 48 having parallel edges 50 and 52 located on one side of the wire 22. Tab 26 also has a front side 54 and a back side 56. A carriage bolt 58 has a head 60, a square neck 62 adjacent the head and external threads 64 for mating with a nut 66. The bolt 58 is passed through the slot 48 and the bolt neck 62 fits closely with the slot parallel edges 50 and 52, as shown in FIG. 3, preventing rotation of the bolt during tightening.

Figure 2:
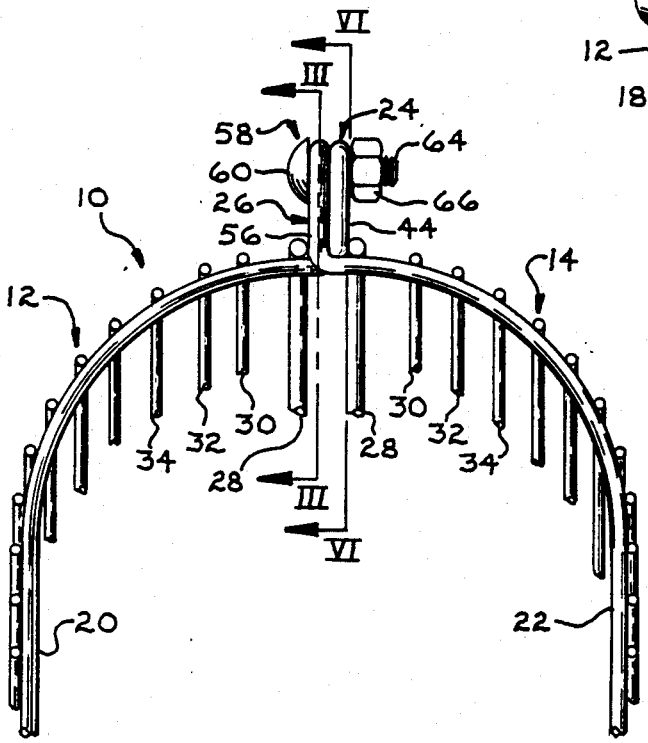
FIG. 2 is an enlarged, partial sectional view of a fan guard in accord with the invention illustrating a pair of tabs in the interlock position.
Figure 4:
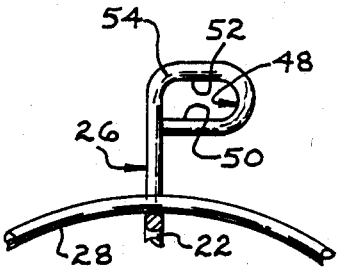
FIG. 4 is a detail elevational view of one of the guard portions tab.
Figure 5:
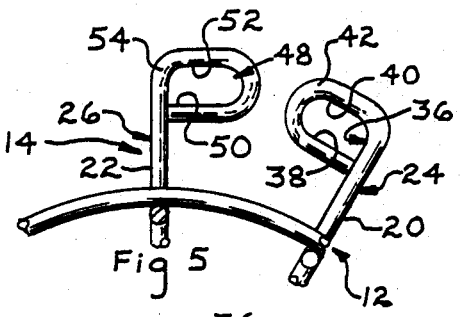
FIG. 5 is an elevational view of the tabs of the front and rear portions prior to rotating the guard portions to the interlock position.
Figure 6:
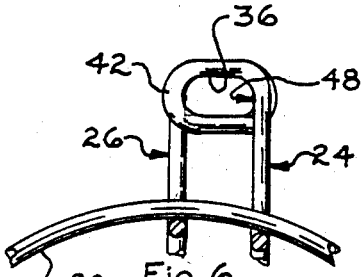
FIG. 6 is a view illustrating the tabs of FIG. 5 after the tabs have been rotated to the interlock position as would appear along Section VI—VI of FIG. 2, the bolt being omitted.

In order to assemble the guard portions 12,14 they are brought together with the peripheral wire rings 28,28, being in adjacent, but spaced, relationship as shown in FIG. 5 to define a joining plane therebetween. By rotating the guard portion 14 clockwise tab 26 is received behind tab 24 in an interlocking position engaging the back side 44 of tab 24 with the front side 54 of tab 26 as shown in FIGS. 2 and 6. Upon the tabs 24 and 26 being in the interlocking "front-to-back" position the parallel slots 36 and 48 align to receive the bolt 58 where the neck 62 is within slot 48 and the nut 66 is tightened to secure the tabs together and prevent separation of the guard portions.

To disassemble the guard portions 12 and 14 it is merely necessary to remove the nut 66 from the bolt 58 and withdraw the bolt from the aligned slots 36 and 48. Rotating the guard portion 14 counterclockwise releases the interlocked tabs and allows separation of the guard portions.

From the above description it will be appreciated that the P configuration of the tab loops permits the relative rotation between the guard portions which interlocks the tabs and thereby increases the resistance to axially separate the guard portions and also significantly simplifies initial assembly of the guard portions before the bolts are inserted in the tabs.

It is appreciated that various modifications to the inventive concepts may be apparent to those skilled in the art without departing from the spirit and scope of the invention.

I claim:

1. A fan guard comprising front and rear guard portions each including an outer periphery and an axis, and means for detachably securing said front and rear guard portions together adjacent the peripheries thereof, the improvement comprising tabs defined on the guard portions adjacent the peripheries thereof, said tabs being offset in an axial direction whereby upon locating the front and rear guard portions peripheries adjacent each other and rotating one of said guard portions relative to each other said tabs overlap in the axial direction to form abutments with each other preventing axial separation of said guard portions, and a fastener interconnecting interlocked tabs.

2. In a fan guard as in claim 1, said tabs having front and back axially oriented sides, the tabs of said front portion being axially offset with respect to the tabs of the rear portion whereby upon disposing said tabs of the portions adjacent each other and rotating the guard portions relative to each other about their axes said tab front sides of the front guard portion engage the back side of the tabs of the rear guard portion in an interlocked relationship preventing axial separation of the guard portions.

3. In a fan guard as in claim 2, said tabs each having an axially extending opening, the opening of interlocked tabs aligning in said interlock position, said fastener comprising a bolt extending through said aligned openings and a nut threaded upon said bolt.

4. In a fan guard as in claim 3, said tab openings having parallel edges, said bolt having a square neck having parallel surfaces disposed adjacent said parallel edges and closely received within said aligned openings for preventing rotation of said bolt during tightening of said nut on said bolt.

5. In a fan guard as in claim 3, each of the guard portions including radially extending wires having an outer end adjacent the associated guard portion periphery, said tabs being defined by a loop formed in said wire ends.

6. In a fan guard as in claim 5, said loops being of a P configuration having an opening offset with respect to the length of the associated wire.

7. In a fan guard as in claim 6, said loops each including substantially parallel spaced edges.

* * * * *